United States Patent [19]

Masuda et al.

[11] Patent Number: 5,006,181

[45] Date of Patent: Apr. 9, 1991

[54] LUBRICATING METHOD FOR WARM ROLLING OF HIGH SILICON STEELS

[75] Inventors: Sadakazu Masuda; Fumio Fujita; Tadayoshi Murakami; Masahiko Yoshino; Ryuichi Yagi; Masamoto Kamata, all of Tokyo, Japan

[73] Assignee: Nippon Kokan Kabushiki Kaisha, Tokyo, Japan

[21] Appl. No.: 294,666

[22] PCT Filed: May 23, 1988

[86] PCT No.: PCT/JP88/00491

§ 371 Date: Dec. 15, 1988

§ 102(e) Date: Dec. 15, 1988

[51] Int. Cl.[5] ..... H01F 1/04

[52] U.S. Cl. ..... 148/111; 72/41; 72/42

[58] Field of Search ..... 148/111; 72/41, 42

[56] References Cited

U.S. PATENT DOCUMENTS 3,575,858 4/1971 Adair et al. ..... 72/42

FOREIGN PATENT DOCUMENTS 53-39174 10/1978 Japan .
59-10404 1/1984 Japan .

*Primary Examiner*—John P. Sheehan
*Attorney, Agent, or Firm*—Henry C. Nields

[57] ABSTRACT

The present invention relates to a lubricating method for warm rolling of high Si steel, where warm rolling is carried out on the high Si steel at temperatures between 200° and 600° C., while a lubricant is sprayed to working rolls or assistant rolls, the lubricant having been produced by mixing a solid lubricant endurable to rolling temperatures into a heat resistant grease.

3 Claims, 5 Drawing Sheets

—--—○ ● Non lubricant

—---—ϕ ϕ Silicone oil

———△ ▲ Invention : Molybdenum disulfide + Heat resistant grease

— — —▽ ▼ Invention : Graphite + Heat resistant grease

----- □ ■ Invention : Molybdenum disulfide + Heat resistant grease and Edge lubrication

LUBRICATING METHOD FOR WARM ROLLING OF HIGH SILICON STEELS

TECHNICAL FIELD

The present invention relates to a method of lubricating parts to be rolled in a warm rolling of high silicon steels.

BACKGROUND OF THE INVENTION

Recently, from standpoint of saving natural sources and energy, small sizings and high efficiency of electromagnetic or electronic parts have been demanded, and soft magnetic property, especially Si steel sheets having excellent iron loss have been also required. It is known that soft magnetic properties of Si steel sheets are improved with increasing of addition of Si and exhibit the maximum permeability at about 6.5 wt %, and since natural electric resistance is high, the iron loss is made small. In this kind of steel sheets, if Si content is greater than 4.0 wt %, workablity is abruptly worsened, and therefore it has been impossible to produce high Si steel sheets in industrial scales by the rolling process, but it has been found that the warm rolling could be performed on the thin steel sheets.

For warm rolling (200° to 600° C.) this kind of steel sheets, it is important to perform rolling and lubricating as keeping the above mentioned temperatures for following purposes;

1) preventing a blank from crackings;
2) reducing a rolling load because of large deforming resistance; and
3) satisfying sheet surface property.

The warm rolling is carried out on nonferrous metals as Al. In this rolling, an oil is much applied to lubricate and cool the sheet. However it is very important that the high Si sheet should not be cooled. Surface pressure is very high in comparison with rolling on the nonferrous metals and the above mentioned lubrication is not suited to the warm rolling of the high Si steel sheet.

The lubrication of water soluble coolant is employed to hot rolling, but since this is to cool the steel materials and the rolls, such a lubrication could not be used to the warm rolling of the high Si steel. In cold rolling, the lubricant mixed with an oil and a water is sprayed, but such a lubrication cannot be used to the warm rolling, either, because the temperature of the steel is lowered thereby.

These conventional rolling lubrications could not be adopted to the warm rolling of the high Si steel sheet with less workablility, and a new lubricating way has been demanded for smooth warm rolling.

DISCLOSURE OF THE INVENTION

In view of such circumstances, the inventors have made many studies on warm rolling lubrication of the high Si steel sheets, and they have found that the warm rolling was carried out on the high Si steels at temperatures between 200° and 600° C., while a lubricant was sprayed to working rolls or assistant rolls, the lubricant having been produced by mixing a solid lubricant endurable to rolling temperatures into a heat resistant grease, whereby the rolling is available at low rolling load, not decreasing the rolling temperatures.

In the lubricating practice, the lubricant can be more sprayed to rolls against edges of the sheet than to rolls against the center, thereby to roll the high Si steel by effectively preventing cracks at the sheet edges by applying the lubricant to the edges.

MOST PREFERRED EMBODIMENT FOR PRACTISING THE INVENTION

The present invention performs the warm rolling, while a lubricant is sprayed to working rolls or assistant rolls, the lubricant having been produced by mixing a solid lubricant endurable to rolling temperatures into a heat resistant grease. Molybdenum disulfide or graphite are used for the solid lubricant powders.

Known liquid lubricants to be used at high temperatures are lubricating composite oils such as silicone oil (available temper ature: to 250° C.), fluoric oil (same: to 300° C.) or polyphenyl ether (same: to 450° C.). However, these liquid lubricants are insufficient in ultra rolling properties and lubricating properties with respect to the rollings of hard materials as the high Si steel, and are not suitable as the lubricant. Many of these lubricants are caused with thermal or oxidation dissolutions at high temperatures (around 300° C.) and the lubricating properties are abruptly worsened.

Figure 1:
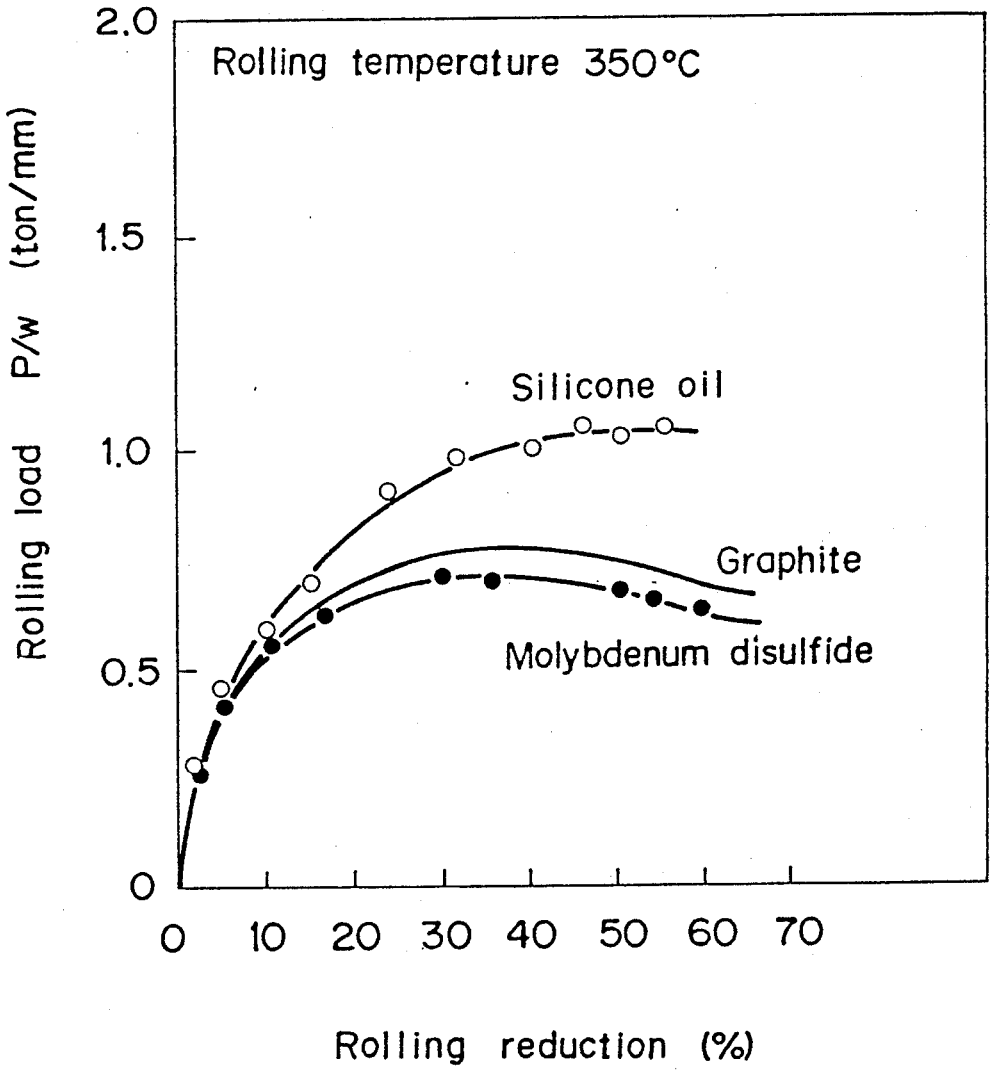
FIG. 1 is a graph showing warm rolling loads on 6.5% Si steel with different lubricants.
Figure 2:
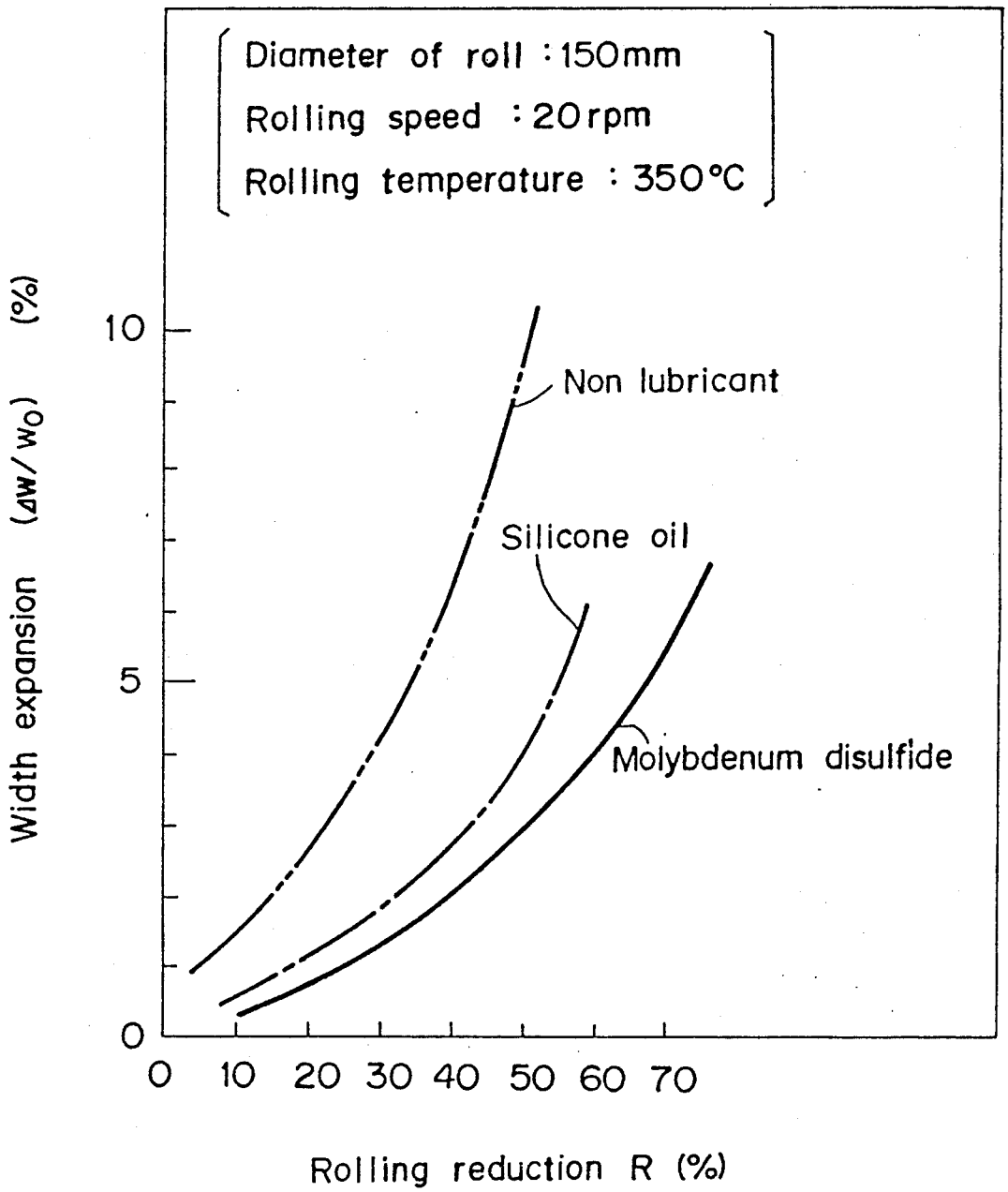
FIG. 2 is a graph showing expansions in width by the warm rolling with different lubricants and non lubricant.

Molybdenum and graphite have the ultra rolling property and lubricating property enough resistant to the rollings of the hard material as the high Si steel, and in addition they can be used at the high temperatures. FIG. 1 shows the rolling loads when the 6.5% Si steels were rolled at the temperature of 350° C. with the lubricants of the silicone oil, molybdenum disulfide and graphite respectively. FIG. 2 shows expansions in width when the 6.5% Si steels were rolled with the lubricants of silicone oil, molybdenum disulfide and non lubricant. It is seen that the rolling loads and the width expansions are effectively decreased in the rollings of the high Si steels. As is seen from FIG. 1, molybdenum disulfide is better than graphite, but if the temperature exceeds 400° C., molybdenum is changed into $MoO_3$ and the lubricating property is suddently lowered, and graphite is better to be used at temperatures of more than 400° C.

With respect to supply of the solid lubricant, a direct supply has difficulties in a continuous rolling line of the high Si steel. For example, since the continuous rolling line is installed with heating furnaces in front of the rolls, it is difficult to keep a space for spraying the lubricant to the both surfaces of the running steel. If the lubricant were paste, the steel would be cooled disadvantageously. The present invention does not directly spray the lubricant to the steel, but sprays the solid lubricant to the working rolls or assistant rolls continuously or intermittently so that the solid lubricant is fed to a rolling entrance. In this practice, the solid lubricant must be spread in the solvent. The solvent is required to be highly viscous in view of the spraying practice, heat resistant because of preheating the rolls and high dispersing. Heat resistant greases are employed to satisfy these matters are employed. The heat resistant grease may be a grease (consistency: 25° C. 380—unvariable up to 200° C., and dropping: more than 250°) where mineral base oil (viscosity: 40° C. to 470° C. cst) is mixed with anti-oxidizing agent and urea organic compound (heat resistant) as thickener.

The mixture of the solid lubriant and the heat resistant grease is determined taking into consideration the lubricating property or fluidity of the lubricant.

Figure 3:
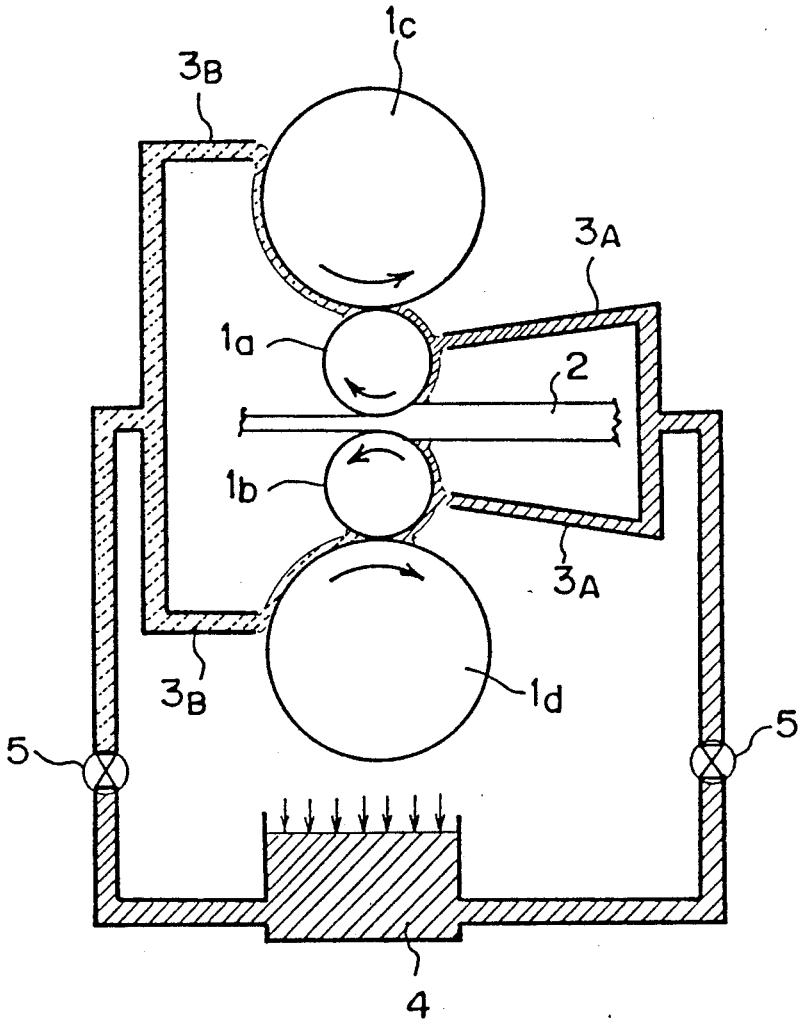
FIG. 3 shows one of embodiments of the invention.

FIG. 3 illustrates one of the embodiments of the invention, where numerals 1*a*,1*b* are upper and lower rolls, 1*c*,1*d* are upper and lower assistant rolls, and 2 is a steel sheet. Lubricant supply nozzles 3A are provided against an entering side of the working rolls 1*a*,1*b*, while lubricant supply nozzles 3B are provided against the assistant rolls at an outlet of the steel sheet 2. The lubricant is fed from a tank 4 through the nozzles 3*a*,3*b*.

If the lubricant were directly sprayed to the working rolls, unwelcome shapes would be caused in the steel sheet by uneven coating amount. In such an occasion, the lubricant is sprayed to the assistant rolls to make the lubricant uniform at contacting parts of the working rolls and the assistant rolls. The lubrican is switched between the working rolls and the assistant rolls by valves 5.

Figure 4:
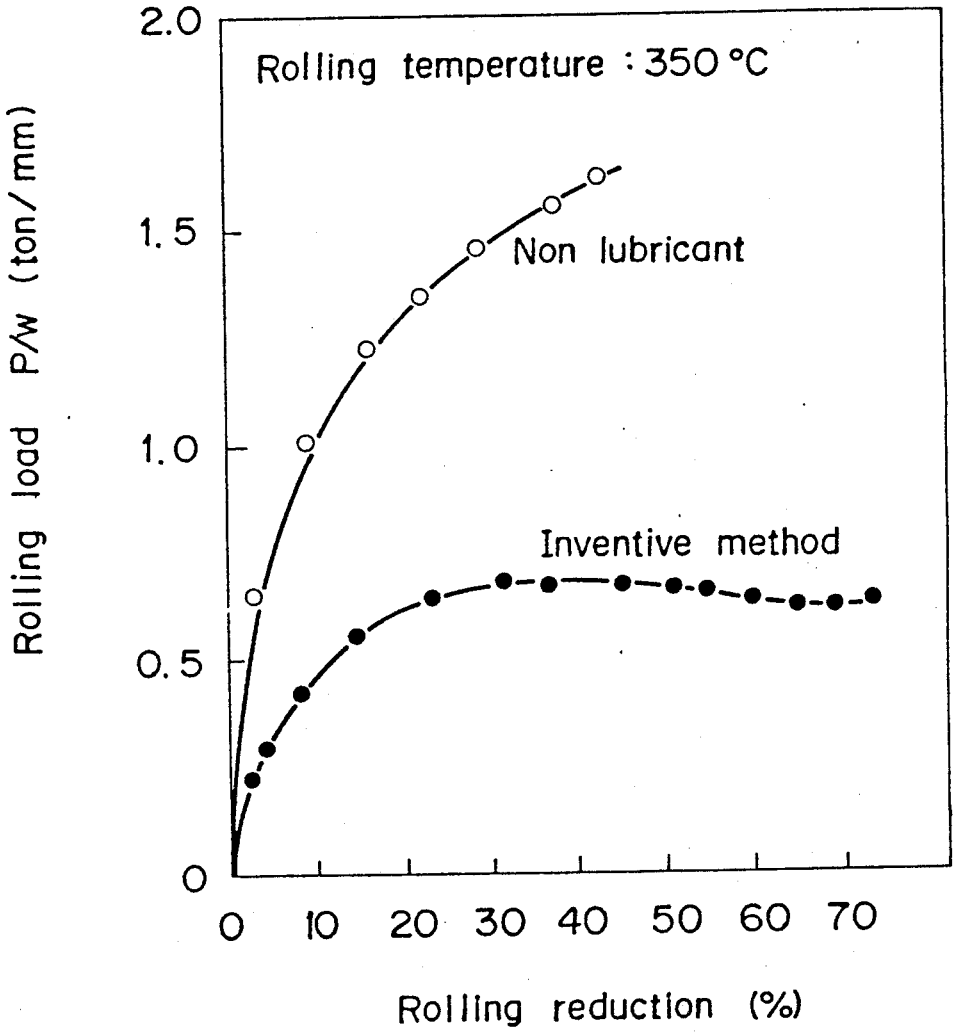
FIG. 4 is a graph showing the warm rolling on 6.5% Si steel by the invention in comparison with non lubricant rolling.

FIG. 4 is a graph showing the rolling loads when the 6.5% Si sheets were rolled by supplying the lubricant mixed with molybdenum disulfide and the heat resistant grease, comparing with the rolling of non lubricant. The rolling load was reduced in the invention.

The preferable embodiment of the invention is that the lubricant can more sprayed to the rolls against the edges of the sheet than to the rolls against the center, thereby to roll the high Si steel sheet by effectively preventing cracks at the sheet edges by applying the lubricant to the edges. The rolling of the high Si steel has a big problem of cracking the edges, and if the lubricant is much sprayed to the edge parts, elongation is made large there, and stress in length of the edge is compressed so that the edge cracking may be avoided.

Depending upon the lubrication at the edges, the lubricant nozzle 3 as shown in FIG. 3 is divided in length of the rolls, and the lubricant supply amount may be changed.

Figure 5:
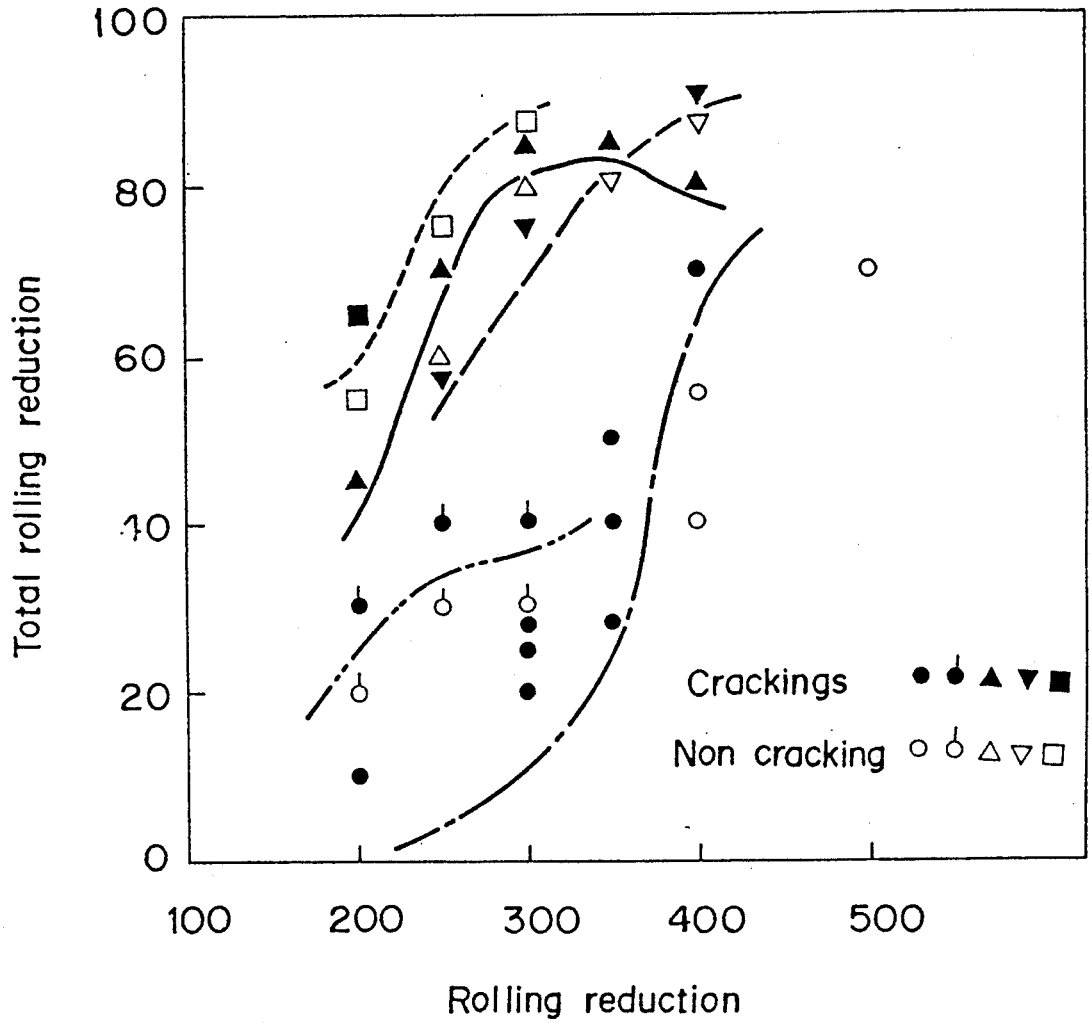
FIG. 5 is a graph showing limits of cracks when the warm rollings were carried out by the present method, the comparison method and non lubricant rolling.

FIG. 5 is a graph showing limits of rolling cracks when the warm rolling were carried out by the the present method, the comparison method and non lubricant rolling. In this practice, the cracks are avoided in the present method where the rolling is carried out, while lubricant is much applied to the edge parts.

In the invention, the warm rolling may be done on the high Si steel without lowering the temperature of the steel material and with exactly reducing the rolling load.

INDUSTRIAL APPLICABILITY

This invention may be applied to the warm rolling of the high Si steels, especially of containing more than 4.0 wt %.

What is claimed is:

1. A lubricating method for warm rolling of high Si steels, wherein warm rolling is carried out on a high Si steel at temperatures between 200° and 600° C., while a lubricant is sprayed on to the working rolls or assistant rolls, the lubricant having been produced by mixing graphite or $MoS_2$ into a heat resistant grease.

2. The method as claimed in claim 1, wherein more lubricant is sprayed on to the rolls against edges of the sheet than to the rolls against the center thereof.

3. The method as claimed in claim 1 or 2, wherein graphite and/or molybdenum disulfide are used as solid lubricant.

* * * * *